US008465307B2

(12) United States Patent
Shieh et al.

(10) Patent No.: US 8,465,307 B2
(45) Date of Patent: Jun. 18, 2013

(54) POWER SUPPLY UNIT WITH REPLACEABLE PLUG

(75) Inventors: Shuo-Jen Shieh, New Taipei (TW); Yi-Sheng Liu, Taoyuan County (TW); Wen-Chi Chen, Taipei (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 46 days.

(21) Appl. No.: 13/288,121

(22) Filed: Nov. 3, 2011

(65) Prior Publication Data

US 2012/0322290 A1 Dec. 20, 2012

(30) Foreign Application Priority Data

Jun. 15, 2011 (CN) ..... 2011 2 0200310 U

(51) Int. Cl.
*H01R 29/00* (2006.01)

(52) U.S. Cl.
USPC ..... 439/173

(58) Field of Classification Search
USPC ..... 439/171–173, 345, 518, 217, 218, 439/52–53, 166, 638, 695, 956
See application file for complete search history.

(56) References Cited

U.S. PATENT DOCUMENTS

| | | | | |
|---|---|---|---|---|
| 7,008,246 | B2 * | 3/2006 | Zhuge | 439/173 |
| 7,264,492 | B2 * | 9/2007 | Liang | 439/171 |
| 7,874,853 | B2 * | 1/2011 | Chiang et al. | 439/173 |
| 7,946,884 | B2 * | 5/2011 | Chiang et al. | 439/518 |
| 8,267,705 | B2 * | 9/2012 | Huang | 439/171 |

* cited by examiner

*Primary Examiner* — R S Luebke
*Assistant Examiner* — Harshad Patel
(74) *Attorney, Agent, or Firm* — Li & Cai Intellectual Property (USA) Office

(57) ABSTRACT

The instant disclosure relates to a power supply unit that is compatible with different plug types and can be plugged to the power outlet at different directions. The power supply unit comprises a main body and a plug. The plug can be assembled to and connected electrically with the main body with ease. The power supply unit can be used more broadly in different regions and provide more options when plugging to the power outlet.

19 Claims, 9 Drawing Sheets

POWER SUPPLY UNIT WITH REPLACEABLE PLUG

BACKGROUND OF THE INVENTION

1. Field of the Invention

The instant disclosure relates to a power supply unit; more particularly, to a power supply unit that is compatible with different plug types and can be plugged in different directions.

2. Description of Related Art

The electrical plugs of power supply units and their corresponding sockets adapted by various countries often differ in shapes and sizes. The voltage of the power supply varies regionally as well. Therefore, a user may not be able to use his/her electronic device while traveling abroad, since the power plug may not fit into the local power outlet.

To address the issue, some manufacturers have developed universal power adaptors compatible to different kinds of plugs and outlets. However, these universal power adaptors tend to have complex physical structures and are problem-prone. Another solution was to use a power supply unit with interchangeable plugs. Such power supply unit works with a latch. This latch has a simple design but is structurally vulnerable to external forces. Thereby, the mounted plug tends to unseat easily.

In addition, the pin direction for conventional power supply units is fixed. The fixed direction creates more inconvenience and constraint when plugging the power supply units. Moreover, the plug itself can vary in shapes from country to country and from place to place. For example, some plugs have two flat parallel non-coplanar blades, some are non-parallel, and others have round pins instead. Therefore, the compatibility of the power supply units involves several factors.

Consequently, because of the above limitations resulting from the technical design of prior art, the inventors strive via industrial experience and academic research to develop the instant disclosure, which can effectively improve the limitations described above.

SUMMARY OF THE INVENTION

The instant disclosure provides a power supply unit that is compatible with different plug types and can be plugged in different directions. Being compatible with different types of plugs, the power supply unit can be used in different countries. The ability to plug in different directions allows the power supply unit to have more flexibility in sharing the power strip with other electronic devices. In addition, the power supply unit can be easily assembled, is more reliable, has better structural integrity, etc.

The power supply unit of the instant disclosure comprises a main body and a plug. The main body has a protruding frame-like plug mounting seat and at least one guide rail formed thereon. A receiving region is formed by the area enclosed by the plug mounting seat. The guide rail is arranged in the receiving region. Two conducting elements and a plurality of engagement blocks are mounted in the receiving region. The engagement blocks are specifically arranged within the periphery of the receiving region opposite to each other. An engagement slot is formed on each engagement block. The plug has a base and at least two pins disposed thereon. The pins protrude from the base and are connected to a plurality of first contact pieces and a plurality of second contact pieces, respectively. The first contact pieces are of one polarity and may be formed separately or integrally formed into one piece. Likewise, the second contact pieces of a different polarity may be formed in a similar fashion. The first and second contact pieces are arranged opposite to each other on the base and exposed therefrom. At least a pair of fixing blocks and at least a pair of stoppers are formed protrudingly on the base. Each stopper has a fixing portion formed on one end thereof. A plurality of guide slots are also formed on the base. The plug is movably received by the receiving region, and the guide slots work in cooperation with the corresponding guide rails. The fixing portions are received by the corresponding engagement slots, and the conducting elements abut to the first contact pieces and second contact pieces, respectively, for creating electrical connection.

The power supply unit of the instant disclosure has the following advantages. First, the power supply unit can be fitted with different types of plugs, which provides more flexibility for using in different countries. In particular, the plug can be assembled to the main body of the power supply unit in different angles (e.g., 0, 90, 180, and 270). The angular variation allows more space-wise flexibility for the power supply unit when sharing the same power strip with other electronic devices.

The design of the instant disclosure incorporates the use of guide rail, guide slots, plug mounting seat, fixing blocks, stoppers, etc. Thereby, when assembling the plug onto the base, the plug can be easily assembled thereon and secured in three different directions (x, y, and z axis) to ensure a firm connection.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF PREFERRED EMBODIMENTS

[First Embodiment]

Figure 1:
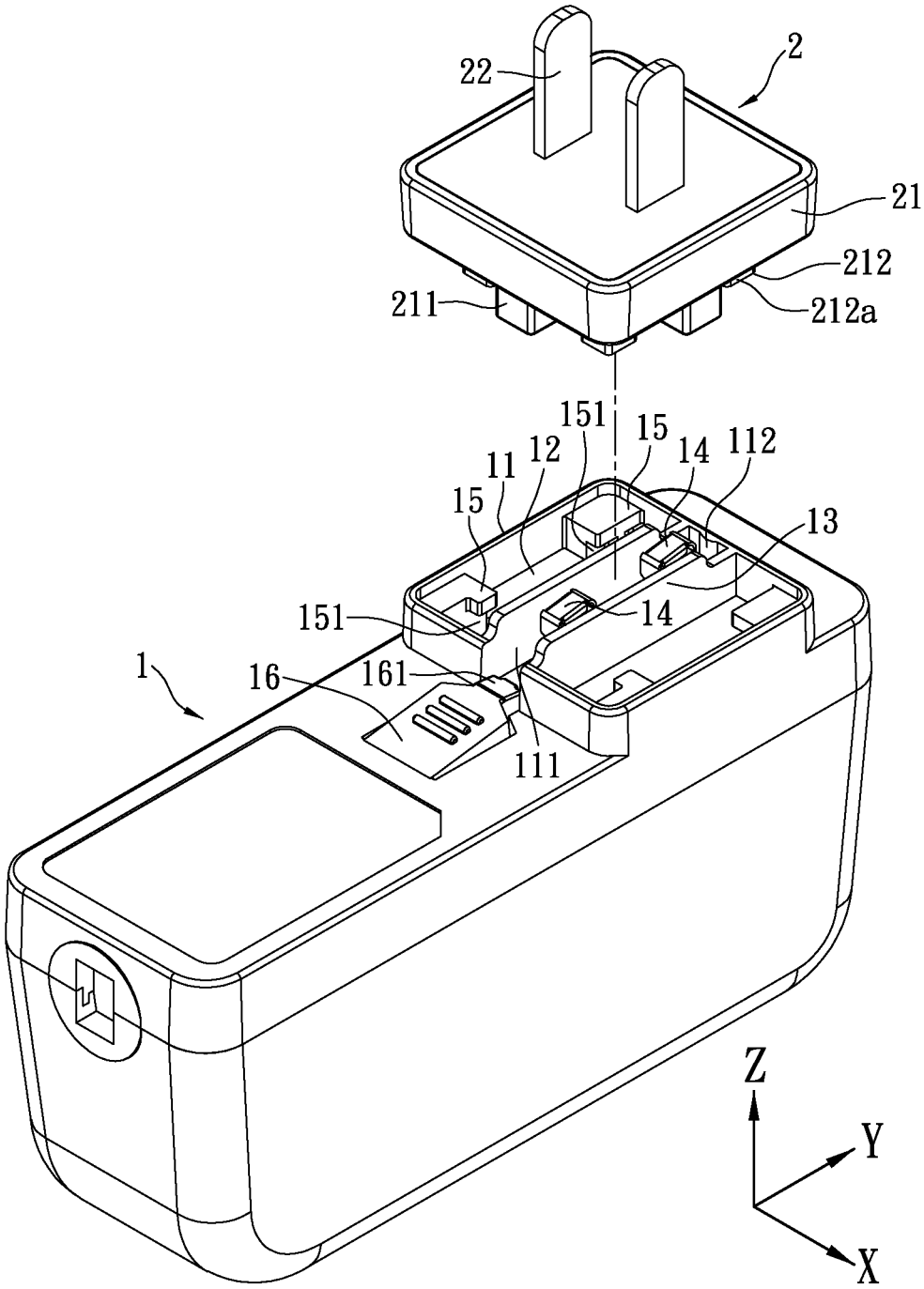
FIG. 1 is an exploded view of a power supply unit of the instant disclosure.
Figure 2:
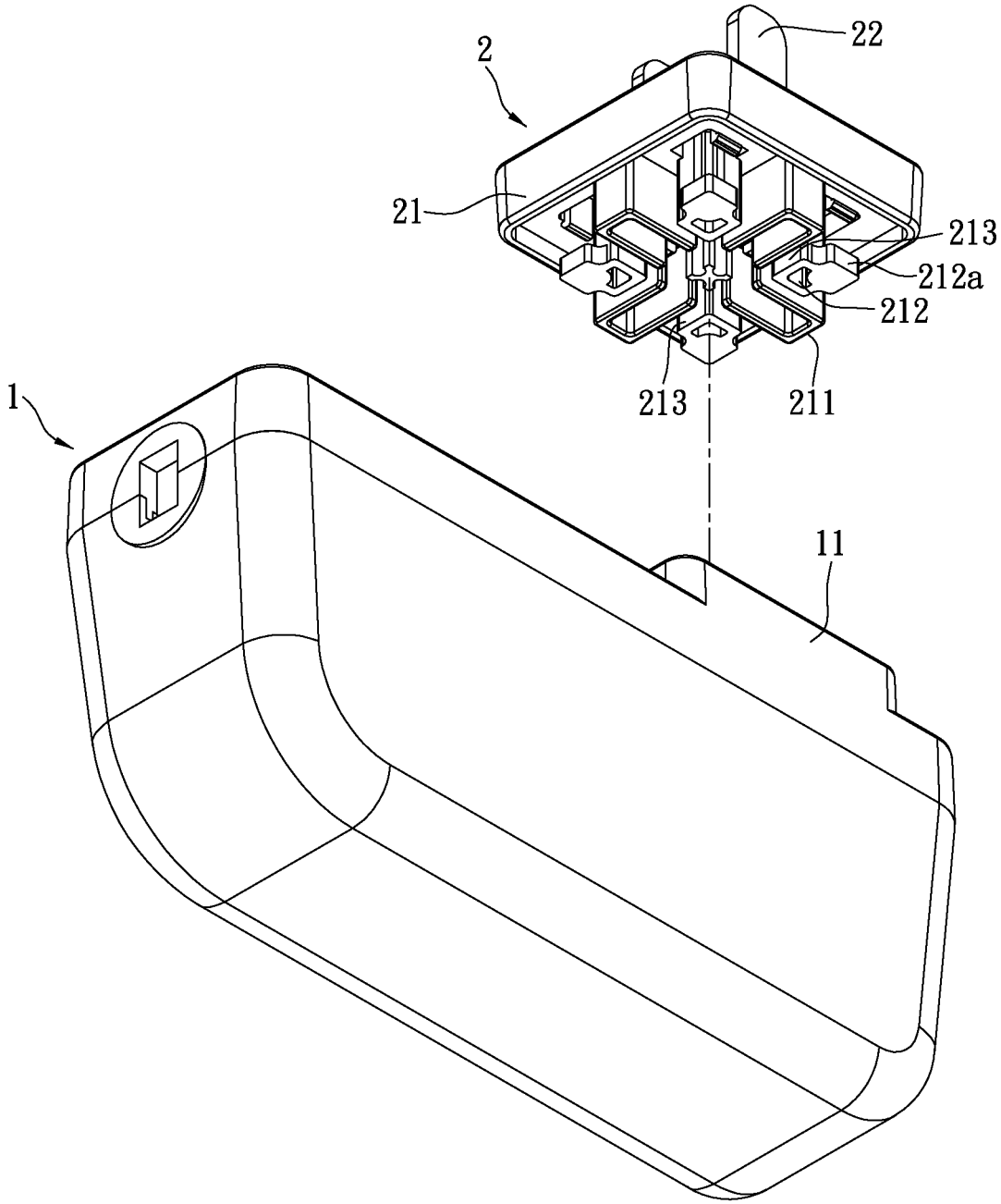
FIG. 2 is another exploded view for the power supply unit of FIG. 1 taken from a different angle.
Figure 3:
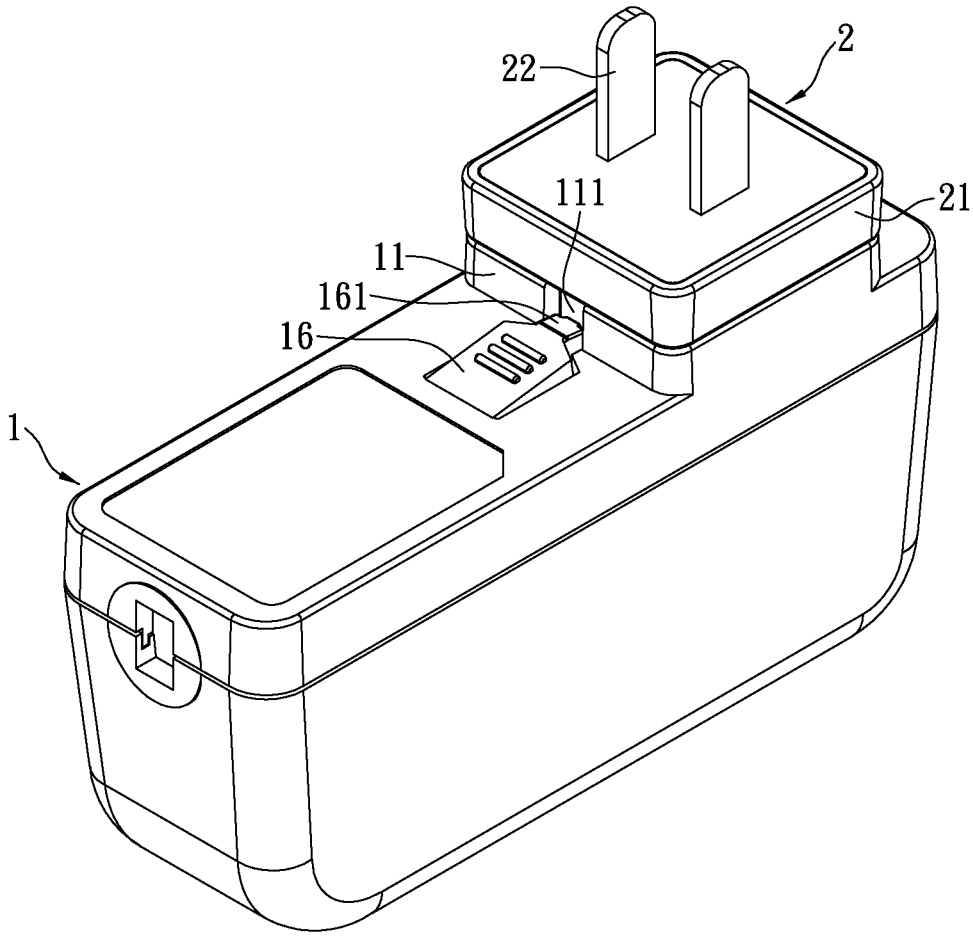
FIG. 3 is a perspective view of the power supply unit of the instant disclosure.

Please refer to FIGS. 1~5, which show a power supply unit that is compatible with different plug types and can be plugged to the power outlet at different directions. The power supply unit may be, but is not limited to, power adaptors, chargers, power converters, or combinations thereof. The power supply unit comprises a main body 1 and a plug 2. For explanation purposes, the crosswise direction of the main body 1 is defined by the x-axis as a first direction X. The longitudinal direction of the main body 1 is defined by the y-axis as a second direction Y. The direction normal to the first and second directions X and Y is represented by the z-axis as a third direction Z.

The main body 1 is a housing structure, which houses various electrical components therein. A plug mounting seat 11 upwardly protrudes from the main body 1. The plug mounting seat 11 is recessed to form a frame-like and square-shaped body that defines a receiving region 12 therein. The plug mounting seat 11 may also be formed as any other regular polygon-shaped structure. The equilateral characteristic of the regular polygon allows the plug 2 to be assembled onto the main body 1 at different angles with respect to a reference plane defined by the x and y axes. At least one guide rail 13 upwardly protrudes from the main body 1 in the receiving region 12. In this embodiment, two guide rails 13 are preferred herein but not restricted thereto. The guide rails 13 extend along the second direction Y and merge with the retaining walls that define the plug mounting seat 11 on opposite ends. The height of the guide rails 13 can be equal to or greater than the retaining walls of the plug mounting seat 11. The two guide rails 13 are spaced apart parrallely in forming an opening 111 therebetween.

Two conducting elements 14 are mounted in the receiving region 12 on the main body 1. Specifically, the conducting elements 14 are arranged between the two guide rails 13 for protection. The guide rails 13 also act as stops to keep the plug 2 from detaching unintentionally from the plug mounting seat 11. Thereby, electric shock due to accidental contact to the exposed conducting elements 14 can be prevented. Alternatively, four guide rails 13 can be formed on the main body 1. In such case, the conducting elements 14 would be bounded by two guide rails 13 on each of both sides thereof. The conducting elements 14 may be metallic resilient strips, cylinders, or any other shapes. The conducting elements 14 are connected electrically with the electrical components inside the main body 1.

Four engagement blocks 15 are preferred herein but not restricted thereto and further disposed inside the receiving region 12 on the main body 1. These engagement blocks 15 are arranged symmetrically within the periphery of the receiving region 12 opposite to each other. Each engagement block 15 can be formed by extending upwardly from the upper surface of the main body 1 and/or inwardly from corresponding retaining walls of the plug mounting seat 11. The locations of forming the engagement blocks 15 on the main body 1 are not restricted. The height of the engagement blocks 15 is equal to or less than the height of the retaining walls of the plug mounting seat 11. An engagement slot 151 is formed between each engagement block 15 and the upper surface of the main body 1. The engagement slots 151 function to secure the plug 2.

A locking member 16 is arranged on the main body 1 adjacent to the plug mounting seat 11. One end of the locking member 16 is connected to the main body 1, while a free end thereof is projected in a sloped manner toward the opening 111 of the plug mounting seat 11. A first stopping portion 161 is formed on the free end of the locking member 16 and extends into the opening 111. A second stopping portion 112 is formed on one of the retaining wall of the plug mounting seat 11 away from the locking member 16.

Figure 4:
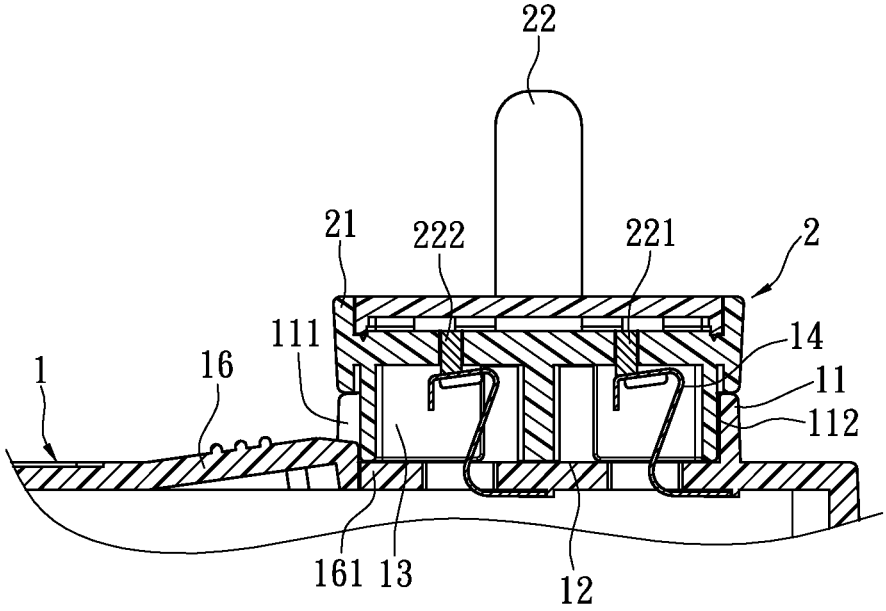
FIG. 4 is a cross-sectional view of the power supply unit of the instant disclosure.
Figure 5:
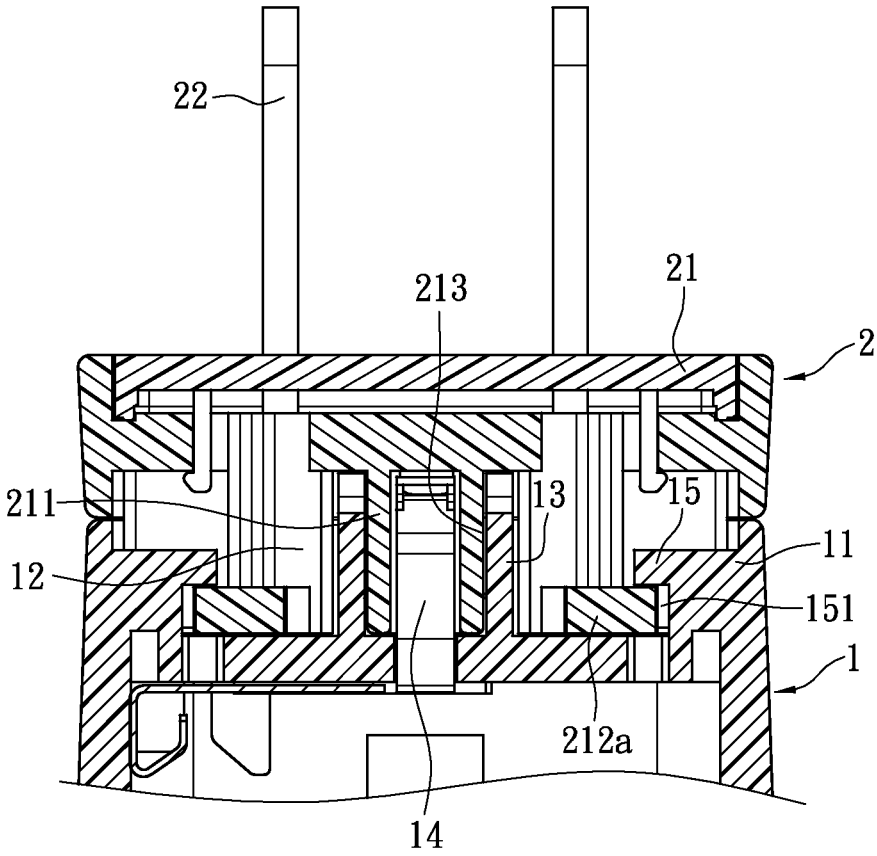
FIG. 5 is another cross-sectional view of the power supply unit of the instant disclosure.
Figure 6:
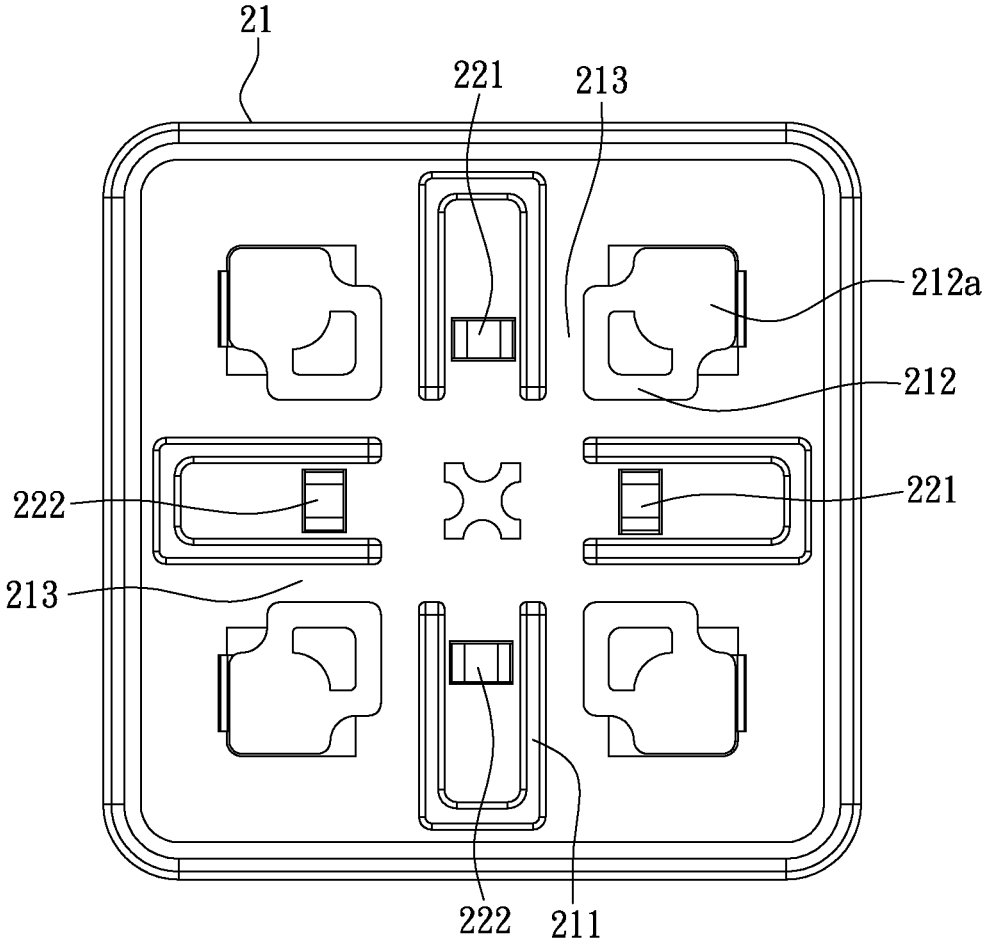
FIG. 6 is a bottom view of a plug of the instant disclosure.

The plug 2 has a base 21 and a pair of pins 22. However, the plug 2 may be provided with more than two pins, such as a three-prong plug having a grounding pin. The base 21 matches in shape with the plug mounting seat 11 structurally. The pins 22 protrude from a front surface of the base 21 along the third direction Z. As shown in FIG. 6, one pin 22 is connected to first contact pieces 221 of one polarity, while the other pin 22 is connected to second contact pieces 222 of a different polarity. The first and second contact pieces 221 and 222 are arranged opposite to each other on a rear surface of the base 21 under exposure. These first and second contact pieces 221 and 222 can be metallic resilient strips, cylinders, or any other type of contact piece. For the instant embodiment, the two conducting elements 14 are resilient strips (as shown in FIG. 4), and the first contact pieces 221 and the second contact pieces 222 are cylindrically-shaped.

Four fixing blocks 211 are preferred herein but not restricted thereto and further protrude downwardly from the base 21 on the same side with the exposing contact pieces 221 and 222. Each fixing block 211 primarily takes a U-shaped form. The fixing blocks 211 can be separately arranged or connected in one piece. For the instant embodiment, these fixing blocks 211 are separately arranged in symmetry. To prevent accidental human contact, the first and second contact pieces 221 and 222 are arranged inside the U-shaped fixing blocks 211.

Four stoppers 212 are preferred herein but not restricted thereto and further formed on the base 21 adjacent to the fixing blocks 211. A fixing portion 212*a* is formed on one end of each stopper 212 in correspondence to the engagement slots 151. The stoppers 212 are arrayed in symmetry on the base 21, and each stopper 212 is arranged between two fixing blocks 211. On the same side with the stoppers 212, a plurality of guide slots 213 is formed between the protruding fixing blocks 211 and the protruding stoppers 212. The number of the guide slots 213 is preferably four but is not restricted thereto. The guide slots 213 are formed symmetrically on the base 21, and each guide slot 213 extends along the first direction X and the second direction Y.

For other embodiments, the number of fixing blocks 211, stoppers 212, guide slots 213, and guide rails 13 can be varied according to the needs. For example, only two stoppers 212 can be used instead. In such case, the two stoppers 212 are arranged on opposite corners of the base 21. The fixing blocks 211, the stoppers 212, and the guide slots 213 are arranged in a symmetrical manner on the plug 2 to be structurally balanced in allowing the plug 2 to stay seated securely on the main body 1. Also, the guide slots 213 are not restricted to be formed between the fixing blocks 211 and the stoppers 212. For example, the guide slot 213 may be formed between any two protruding objects on the base 21.

Please again refer to FIGS. 1~5. When assembling the power supply unit, the plug 2 can be movably inserted into the receiving region 12 of the main body 1, along the third direction Z. Each guide slot 213 of the plug 2 pairs with the corresponding guide rail 13 of the main body 1 for enabling the plug 2 to move along the second direction Y. Meanwhile, the pairings between the guide slots 213 with the corresponding guide rails 13 allow the plug 2 to be fixed in the first direction X. By moving the plug 2 along the second direction Y for a short distance (in positive second direction Y), the fixing portions 212*a* can be received by the corresponding engagement slots 151, which allow the plug 2 to be fixed in the third direction Z. Once the plug 2 is fixed along the first direction X and the third direction Z, one of the fixing blocks 211 would abut to the second stopping portion 112. Concurrently, the locking member 16 would eject, with the first stopping portion 161 abutting the other fixing block 211. Thereby, the plug 2 is fixed in the second direction Y. By securing the plug 2 onto the main body 1 in all three directions, the two conducting elements 14 of the main body 1 are brought in contact with the first contact pieces 221 and the second contact pieces 222, respectively. Thus, the plug 2 is connected electrically to the main body 1. To change out the plug 2, the locking member 16 can be switched to unlocked position to disengage the first stopping portion 161 away from the fixing block 211 of the plug 2. The disengagement loosens the plug 2 in the negative second direction Y. Thus, the plug 2 can be easily removed off the main body 1.

[Second Embodiment]

Figure 8:
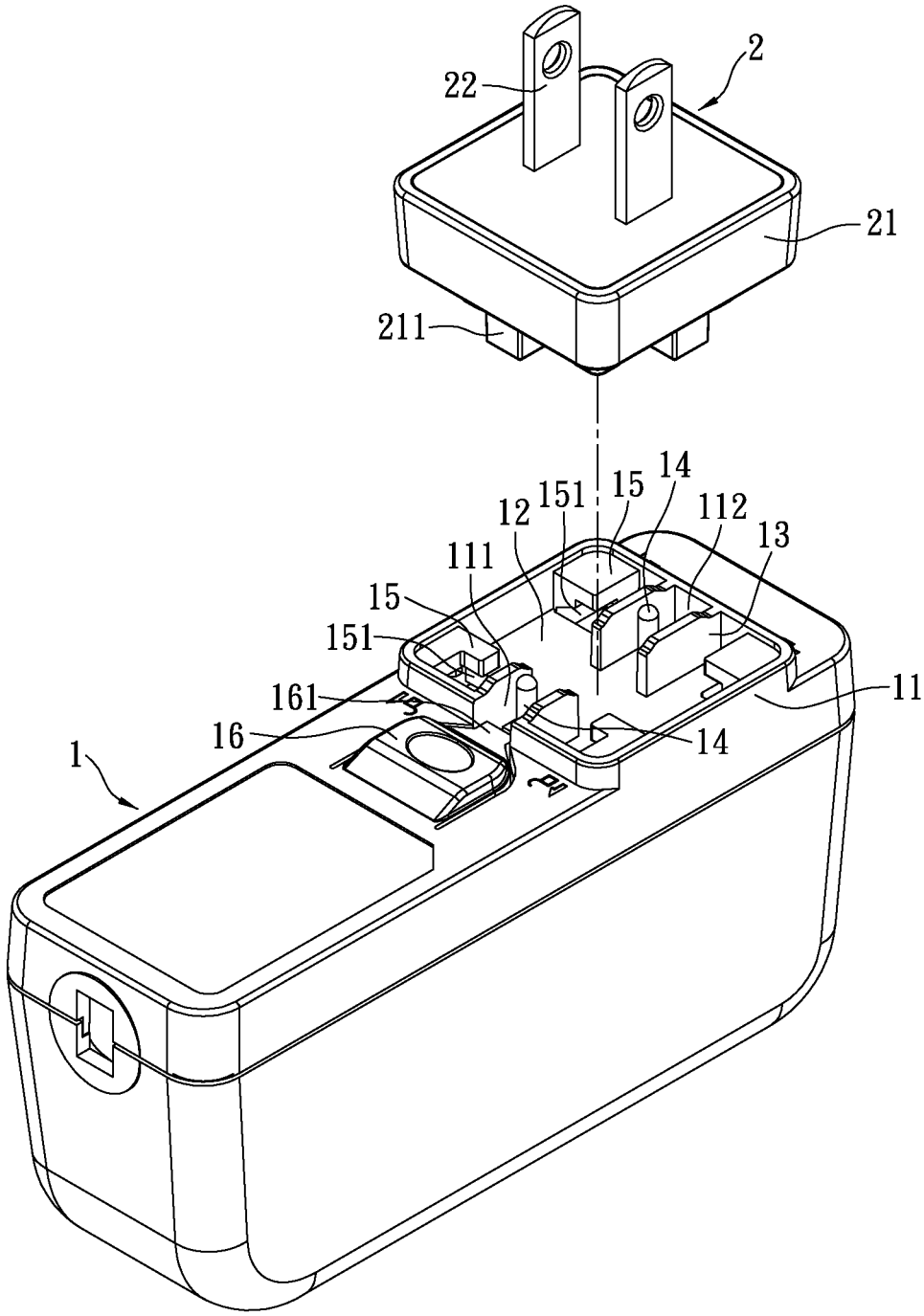
FIG. 8 is an exploded view of a power supply unit for another embodiment of the instant disclosure.
Figure 9:
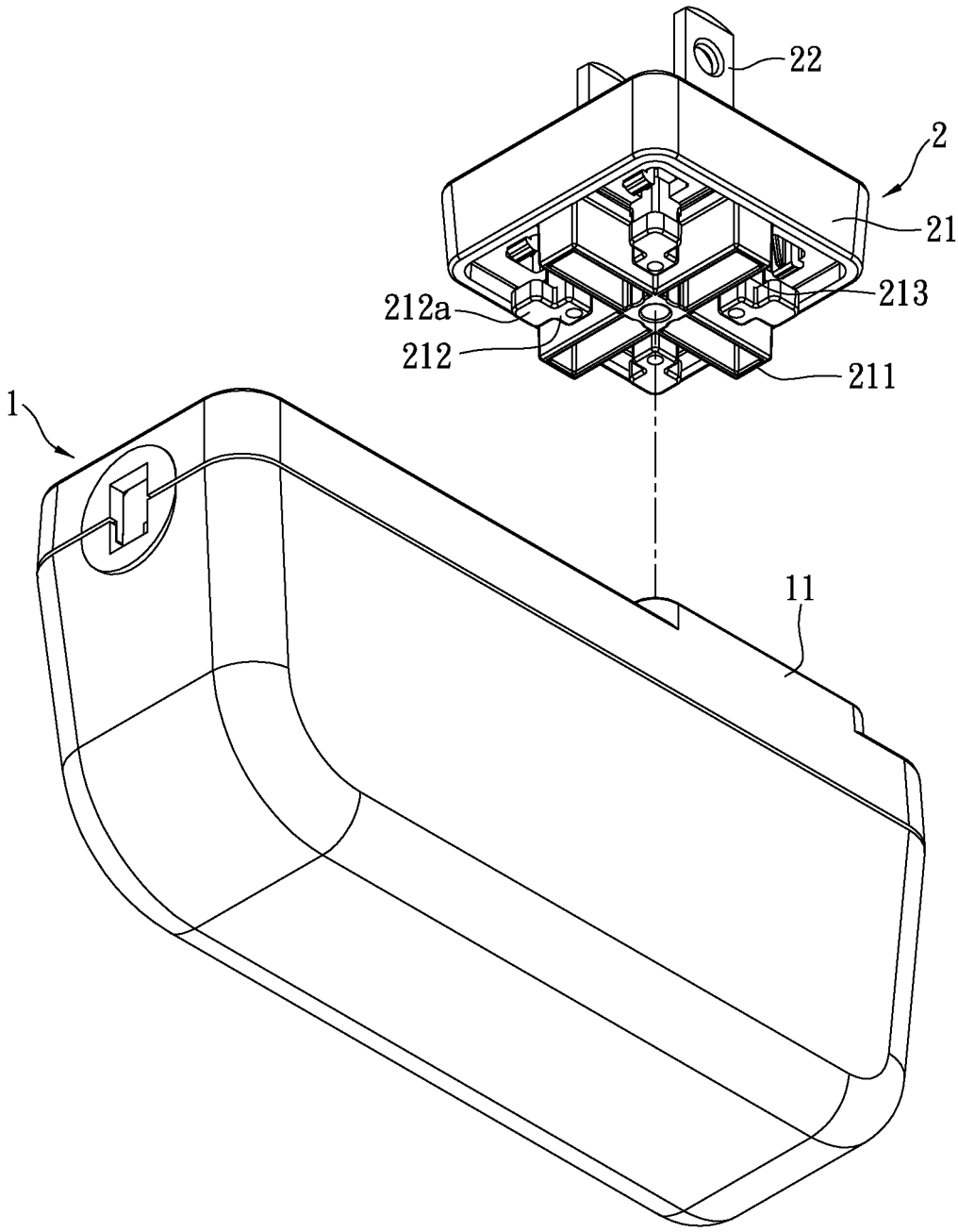
FIG. 9 is another exploded view for the power supply unit of FIG. 8 taken from a different angle.

Please refer to FIGS. 8~9, which show a power supply unit of another embodiment of the instant disclosure. For the instant disclosure, the guide rails 13, the conducting elements 14, the locking member 16, the fixing blocks 211, and the guide slots 213 can all be varied structurally, as illustrated in this embodiment. When comparing to the first embodiment, the middle portions of the two guide rails 13 of the main body 1 are removed. The two conducting elements 14 are replaced with metallic cylindrical bodies and mounted between the two guide rails 13. The shape of the locking member 16 also takes on a different form. The four fixing blocks 211 of the plug 2 are interconnected into one piece in forming a recessed cross-like structure. Aside from structural variations, the assembling process and functions of the power supply unit is generally the same as the previous embodiment, therefore are not repeated herein. Notably, when the conducting elements 14 are cylindrically shaped, the first and second contact pieces 221 and 222 take on the form of resilient strips (not shown).

As with the first embodiment, the number of the fixing blocks 211, the stoppers 212, guide slots 213, and the guide rails 13 for the second embodiment can be varied according to the needs. For example, only two stoppers 212 can be used instead. Under such configuration, the two stoppers 212 are arranged on opposite corners of the base 21. The fixing blocks 211, the stoppers 212, and the guide slots 213 are arranged in a symmetrical manner on the plug 2 to maintain structural stability.

Figure 7:
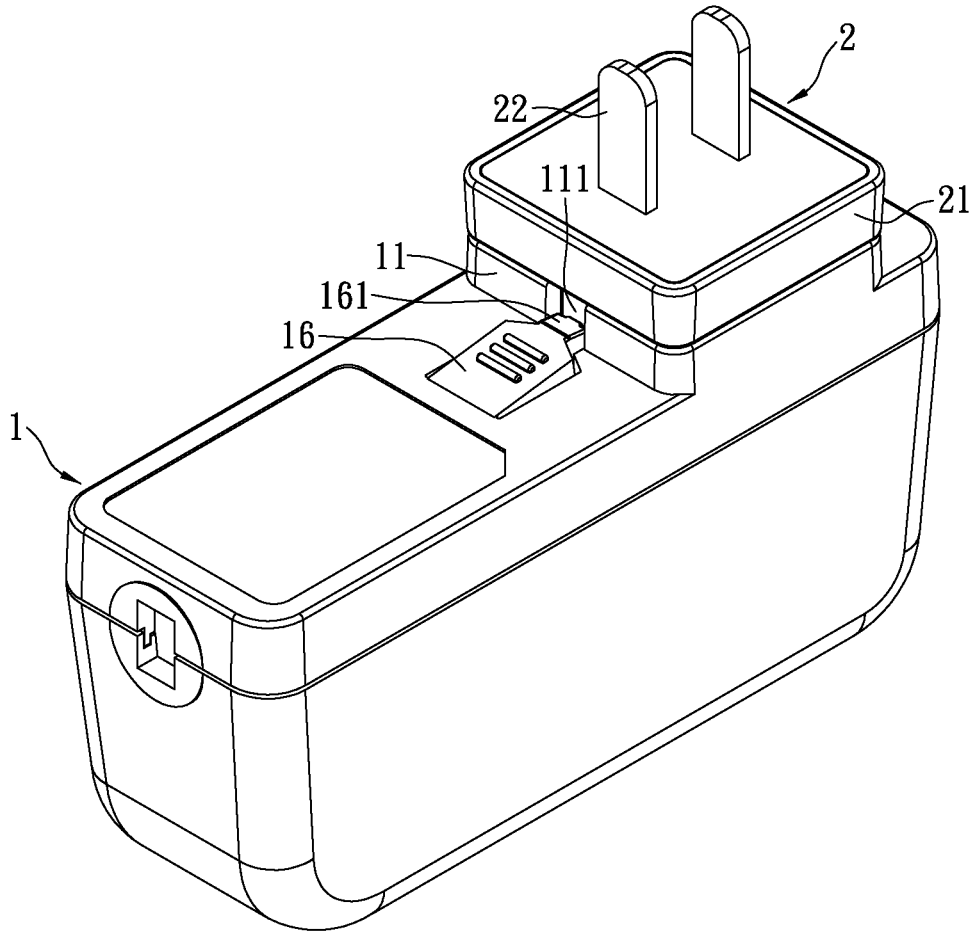
FIG. 7 is a perspective view showing the power supply unit with the plug assembled at a different direction.

For the power supply unit of the instant disclosure, different types of plugs 2 may be assembled onto the main body 1. Thus, the power supply unit can be used in different countries having different power outlets. Moreover, the plug 2 is symmetric structurally, namely the fixing blocks 211, the stoppers 212, and the guide slots 213 are all arranged in a symmetrical manner. Therefore, the plug 2 can be assembled onto the main body 1 in different orientations. For the instant disclosure, with reference to the horizontal plane formed by the x and y axes, the plug 2 can be oriented at 0, 90, 180, and 270 degrees on the main body 1 of the power supply unit. A comparison between FIGS. 3 and 7 demonstrate such characteristic. Thereby, base on needs, the power supply unit of the instant disclosure can change its plug direction to avoid being interfered by other electronic devices while sharing the same power strip.

For the instant disclosure, the plug 2 is secured onto the main body 1 in three directions, i.e., the first direction X, the second direction Y, and the third direction Z. The multi-directional securing capability allows the plug 2 to be firmly secured and provides better structural stability. Plus, the assembling process of the plug 2 onto the main body 1 is less involved. The power supply unit can be easily assembled by first fitting the plug 2 into the receiving region 12 of the main body 1. Then, the plug 2 is moved along the second direction Y for a short distance, which allows the fixing portions 212*a* to engage the corresponding engagement slots 151. The assembling process is simple and efficient.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A power supply unit having replaceable and orientation adjustable plug, comprising:

a main body having a substantially regular polygon-shaped plug mounting seat having enclosing retaining walls that define a receiving region, wherein at least one guide rail and two conducting elements are arranged on the main body in the receiving region, wherein a plurality of engagement blocks are arranged within the periphery of the receiving region opposite to each other, wherein an engagement slot is formed on each engagement block;

a plug, comprising a base;

at least two pins protrudingly arranged on a front surface of the base;

a plurality of first contact pieces and a plurality of second contact pieces arranged on a rear surface of the base and connected to the respective pins;

at least a pair of fixing blocks arranged on the rear surface of the base;

at least a pair of stoppers arranged on the rear surface of the base, wherein a fixing portion is formed on the free end of each stopper; and a plurality of guide slots formed on the rear surface of the base;

wherein the plug is removably received in the plug mounting seat, wherein each guide slot thereof pairs with one of the at least one guide rail, wherein the fixing portions of the plug are received by the corresponding engagement slots for securing the plug to the main body, and wherein the conducting elements of the main body abut to the corresponding first contact pieces and the second contact pieces of the plug for establishing electrical connection.

2. The power supply unit of claim 1, wherein four fixing blocks and four stoppers are arrayed symmetrically, and wherein two first contact pieces and two second contact pieces are arranged within the corresponding fixing blocks and exposed from the rear surface of the base.

3. The power supply unit of claim 2, wherein a locking member is disposed on the main body and adjacent to the plug mounting seat, wherein a first stopping portion is formed on one end of the locking member and abut to one of the fixing block, wherein a second stopping portion is formed on the retaining wall of the plug mounting seat away from the locking member and abut to the other fixing block, and wherein the locking member is connected on one end to the main body opposite of the first stopping portion.

4. The power supply unit of claim 3, wherein an opening is formed on one side of the plug mounting seat adjacent to the first stopping portion of the locking member.

5. The power supply unit of claim 2, wherein the two first contact pieces are of one polarity while the two second contact pieces are of a different polarity.

6. The power supply unit of claim 5, wherein the two first contact pieces and the two second contact pieces are arranged opposite to each other.

7. The power supply unit of claim 1, wherein the plug mounting seat has a frame-like shape, and wherein the base of the plug is shaped compatibly to the plug mounting seat.

8. The power supply unit of claim 1, wherein the height of the guide rail is equal to or greater than the height of the retaining walls of the plug mounting seat.

9. The power supply unit of claim 1, wherein two guide rails are arranged on the main body within the receiving region, and wherein the two conducting elements are arranged between the two guide rails.

10. The power supply unit of claim 1, wherein four guide rails are arranged on the main body within the receiving region, and wherein each conducting element is arranged between two guide rails.

11. The power supply unit of claim 1, wherein the guide rail is breached at the middle portion thereof, and wherein the fixing blocks are interconnected into a one-piece structure.

12. The power supply unit of claim 1, wherein the guide slots are formed between the fixing blocks and the stoppers.

13. The power supply unit of claim 1, wherein the engagement blocks are formed by extending upwardly from the top surface of the main body and inwardly from the retaining walls of the plug mounting seat toward the receiving region.

14. The power supply unit of claim 13, wherein the height of the engagement blocks is equal to or lower than the height of the retaining walls of the plug mounting seat, and wherein the engagement slot is formed between each engagement block and the top surface of the main body.

15. The power supply unit of claim 1, wherein the engagement blocks are formed by extending inwardly from the retaining walls of the plug mounting seat toward the receiving region.

16. The power supply unit of claim 15, wherein the height of the engagement blocks is equal to or lower than the height of the retaining walls of the plug mounting seat, and wherein the engagement slot is formed between each engagement block and the top surface of the main body.

17. The power supply unit of claim 1, wherein the fixing blocks are U-shaped.

18. The power supply unit of claim 1, wherein the fixing blocks are arranged symmetrically opposite to each other, and wherein the first contact pieces and the second contact pieces are arranged within the corresponding fixing blocks.

19. The power supply unit of claim 1, wherein the stoppers are arranged symmetrically opposite to each other.

* * * * *